US007653329B2

(12) United States Patent
Sasai

(10) Patent No.: US 7,653,329 B2
(45) Date of Patent: Jan. 26, 2010

(54) IMAGE FORMING DEVICE HAVING VARIABLE PRE-ROTATION CLEANING PROCESS

(75) Inventor: Takahiro Sasai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 497 days.

(21) Appl. No.: 11/457,868

(22) Filed: Jul. 17, 2006

(65) Prior Publication Data

US 2007/0041740 A1 Feb. 22, 2007

(30) Foreign Application Priority Data

Aug. 17, 2005 (JP) ..... 2005-236854

(51) Int. Cl.
*G03G 21/00* (2006.01)

(52) U.S. Cl. ..... 399/127; 399/347

(58) Field of Classification Search ..... 399/43, 399/44, 127, 71, 128, 129, 347
See application file for complete search history.

(56) References Cited

U.S. PATENT DOCUMENTS

| | | | | |
|---|---|---|---|---|
| 4,380,386 | A * | 4/1983 | Yasuda et al. | 399/43 |
| 4,474,455 | A * | 10/1984 | Hirakura et al. | 399/128 |
| 4,540,270 | A * | 9/1985 | Imanaka et al. | 399/127 |
| 5,130,749 | A * | 7/1992 | Tanada | 399/76 |
| 6,181,890 | B1 * | 1/2001 | Kataoka et al. | 399/67 |
| 6,567,626 | B2 * | 5/2003 | Akaike et al. | 399/75 |
| 7,068,957 | B2 * | 6/2006 | Shimura et al. | 399/49 |
| 2004/0218939 | A1 | 11/2004 | Motohashi et al. | |

FOREIGN PATENT DOCUMENTS

| | | | |
|---|---|---|---|
| JP | 07-134454 A | | 5/1995 |
| JP | 11190931 A | * | 7/1999 |
| JP | 2000-293068 A | | 10/2000 |
| JP | 2001-194980 A | | 7/2001 |
| JP | 2002221835 A | * | 8/2002 |
| JP | 2004-101838 A | | 4/2004 |
| JP | 2004101838 A | * | 4/2004 |
| JP | 2004-258534 A | | 9/2004 |
| JP | 2005-062907 A | | 3/2005 |

OTHER PUBLICATIONS

Official communication issued in counterpart Japanese Application No. 2005-236854, mailed on Jun. 30, 2009.

* cited by examiner

*Primary Examiner*—Robert Beatty
(74) *Attorney, Agent, or Firm*—Keating & Bennett, LLP

(57) ABSTRACT

An image forming device includes a motor, a photoconductive drum, a charging unit, an abrasion tool, a timer, and a controller. The charging unit is provided at a periphery of the photoconductive drum, and charges the photoconductive drum by a corona discharge method. The abrasion tool is provided at the periphery of the photoconductive drum, and abrades the surface of the photoconductive drum while the photoconductive drum is rotating. The timer measures a job interval from when the motor is stopped to end a previous print job until when the motor is driven to start a next print job. The controller executes over a predetermined period of time a pre-rotation process to adjust the photoconductive drum and a peripheral system of the photoconductive drum into an optimum state, and calculates a period when the pre-rotation process is to be executed according to the measured job interval.

11 Claims, 6 Drawing Sheets

IMAGE FORMING DEVICE HAVING VARIABLE PRE-ROTATION CLEANING PROCESS

BACKGROUND OF THE INVENTION

1. Field of the Invention

The present invention relates to an image forming device in which a photoconductive drum is charged by a corona discharge method. In particular, the present invention relates to an image forming device which optimizes the photoconductive drum and a peripheral system of the photoconductive drum at a start of a print job by carrying out a pre-rotation process.

2. Description of the Related Art

Many copy machines and facsimile machines or the like function as an image forming device which forms an image on printing paper according to image data scanned from an original document or image data received by facsimile. In the image forming device, light is irradiated on a uniformly charged photoconductive drum according to the image data to be printed, and an electrostatic latent image is formed. Toner is supplied onto the electrostatic latent image, and the electrostatic latent image is formed into a toner image. Then, the toner image is transferred onto the printing paper. As one charging method of the photoconductive drum, a corona discharge method has been conventionally used. The corona discharge method is a non-contact charging method. Under the corona discharge method, a high voltage is applied to a tungsten corona wire or the like. Accordingly, a corona discharge generates between the corona wire and the photoconductive drum. When the corona is being discharged, ions generated as a result of ionization of the surrounding air are guided towards the photoconductive drum. As a result, the surface of the photoconductive drum is charged.

In the image forming device using the corona discharge method, when the corona is being discharged, discharge product gases such as $NO_x$ and $O_3$ are generated. There exists a problem that a normal image forming process is inhibited by the discharge product gases. For example, $NO_x$ combines with moisture in the air to form $HNO_2$. When $HNO_2$ adheres onto the photoconductive drum, $HNO_2$ melts the surface of the photoconductive drum to make the surface uneven. As a result, the charging of the surface of the photoconductive drum is inhibited. Additionally, $O_3$ prevents a movement of the charge on the photoconductive drum. As a result, a formation of an electrostatic latent image is blocked. Therefore, a fan or the like is arranged in the image forming device to discharge the corona product gases to the outside of the image forming device. However, when the discharge product gases are not completely discharged and remain inside the image forming device, the discharge product gases pollute the surface of the photoconductive drum. Accordingly, during a pre-rotation process carried out at a start of a print job, the polluted surface of the photoconductive drum is required to be refreshed. The pre-rotation process is a process for adjusting the photoconductive drum and the peripheral system of the photoconductive drum into an optimum state by securing a given period of time at the start of the print job in order to enable a normal image forming process. During the pre-rotation process, for example, since a cleaning blade makes contact with the photoconductive drum, the polluted surface of the photoconductive drum is abraded and a new surface is exposed.

The period of time required for the pre-rotation process changes according to a surrounding environmental condition. Therefore, a conventionally proposed method provides a temperature sensor for measuring an outside air temperature and optimizes a pre-rotation period according to this measurement result.

However, in the above-described conventional image forming device, no consideration is made regarding an aspect that a level of pollution of the photoconductive drum changes according to a period from a completion of a previous print job until a start of a next print job. That is, when the image forming device is left for a long period of time without a print job being executed, for example, from an end of a week until a beginning of the next week, the level of the pollution on the surface of the photoconductive drum caused by the discharge product gases is high. Meanwhile, when a next print job is started immediately after a completion of a previous print job, the level of the pollution on the surface of the photoconductive drum is low. However, in the conventional image forming device, an execution period of the pre-rotation process is constant regardless of a job interval. Therefore, when the image forming device is left for a long period of time and the level of the pollution of the photoconductive drum is high, a normal image forming process cannot be carried out due to insufficient cleaning. Meanwhile, when the image forming device is left for a short period of time and the level of the pollution of the photoconductive drum is low, the pre-rotation process is carried out over an unnecessarily long period of time. As a result, the start of the next print job is delayed.

SUMMARY OF THE INVENTION

In order to overcome the problems described above, according to preferred embodiments of the present invention, in an image forming device which charges a photoconductive drum by a corona discharge method, regardless of an elapse of time from the completion of a previous print job, the photoconductive drum polluted by discharge product gases is reliably refreshed during a pre-rotation process carried out at a start of the print job. Therefore, a satisfactory image quality can be obtained from a first sheet of the print job.

According to a preferred embodiment of the present invention, an image forming device includes a motor, a photoconductive drum, a charging unit, and an abrasion tool. The photoconductive drum is driven and rotated by the motor, and a photoconductive layer is formed on a surface of the photoconductive drum. The charging unit is arranged at a periphery of the photoconductive drum and charges the photoconductive drum by the corona discharge method. The abrasion tool abrades the surface of the photoconductive drum while the photoconductive drum is rotating. After the motor is driven and a print job is started, a pre-rotation process is executed over a predetermined period of time. Further, the pre-rotation process is a process for adjusting the photoconductive drum and a peripheral system of the photoconductive drum into an optimum state. In such an image forming device, a job interval is measured from when the motor is stopped to end the previous print job until when the motor is driven to start the next print job. According to the measured job interval, an execution period of the pre-rotation process for the next print job is calculated.

According to the above-described image forming device, the execution period of the pre-rotation process is calculated according to the job interval. Therefore, the pre-rotation process can be executed for the optimum execution period according to the level of the pollution on the photoconductive drum. Accordingly, it is possible to prevent insufficient refreshing of the photoconductive drum when the level of the pollution is high. In addition, since the pre-rotation process is not carried out over an unnecessarily long period of time when the level of the pollution is low, it is possible to prevent a delay in the start of the next print job.

In the image forming device, a first sheet of the printing paper is preferably fed in synchronism with an end of the pre-rotation process.

According to such a preferred embodiment, the first sheet of the printing paper is fed at the same time as the end of the pre-rotation process. Therefore, it is possible to shorten a period of time required from when a print job execution command is issued until when the print job is completed.

The image forming device further includes a fixing unit which heats and fixes a toner image transferred onto the printing paper from the photoconductive drum. In this case, the execution period of the pre-rotation process for the next print job is preferably a theoretical value of an execution period calculated based on the job interval or a period of time required from when the next print job is started until when the fixing unit reaches a predetermined paper feed starting temperature, whichever is longer.

According to such a preferred embodiment, even when the theoretical value of the execution period of the pre-rotation process is small, a minimum required execution period is secured such that a fixing unit temperature reaches a temperature necessary for fixing the toner image when the printing paper passes through the fixing unit. As a result, it is possible to prevent insufficient fixing by the fixing unit.

The image forming device also includes an environmental condition sensor which detects an environmental condition near the photoconductive drum. In this case, the execution period of the pre-rotation process for the next print job is preferably corrected according to a detection result of the environmental condition sensor.

According to such a preferred embodiment, the execution period of the pre-rotation process is corrected according to the environmental condition. Therefore, the execution period of the pre-rotation process can take an even more optimum value according to the level of the pollution on the photoconductive drum.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

A description will be made of an image forming device according to preferred embodiments of the present invention with reference to the drawings. The image forming device is preferably a copy-and-facsimile Multi Function Peripheral (MFP) including a copying function for copying an original document, a facsimile communication function, and an Internet facsimile communication function, or the like. The copy-and-facsimile MFP forms an image on printing paper in accordance with image data scanned from the original document or image data received by facsimile. The present invention is not limited to the copy-and-facsimile MFP. For example, the present invention is applicable to a copying machine including only a copying function or a facsimile machine including only a facsimile communication function, or any other suitable machine.

Figure 1:
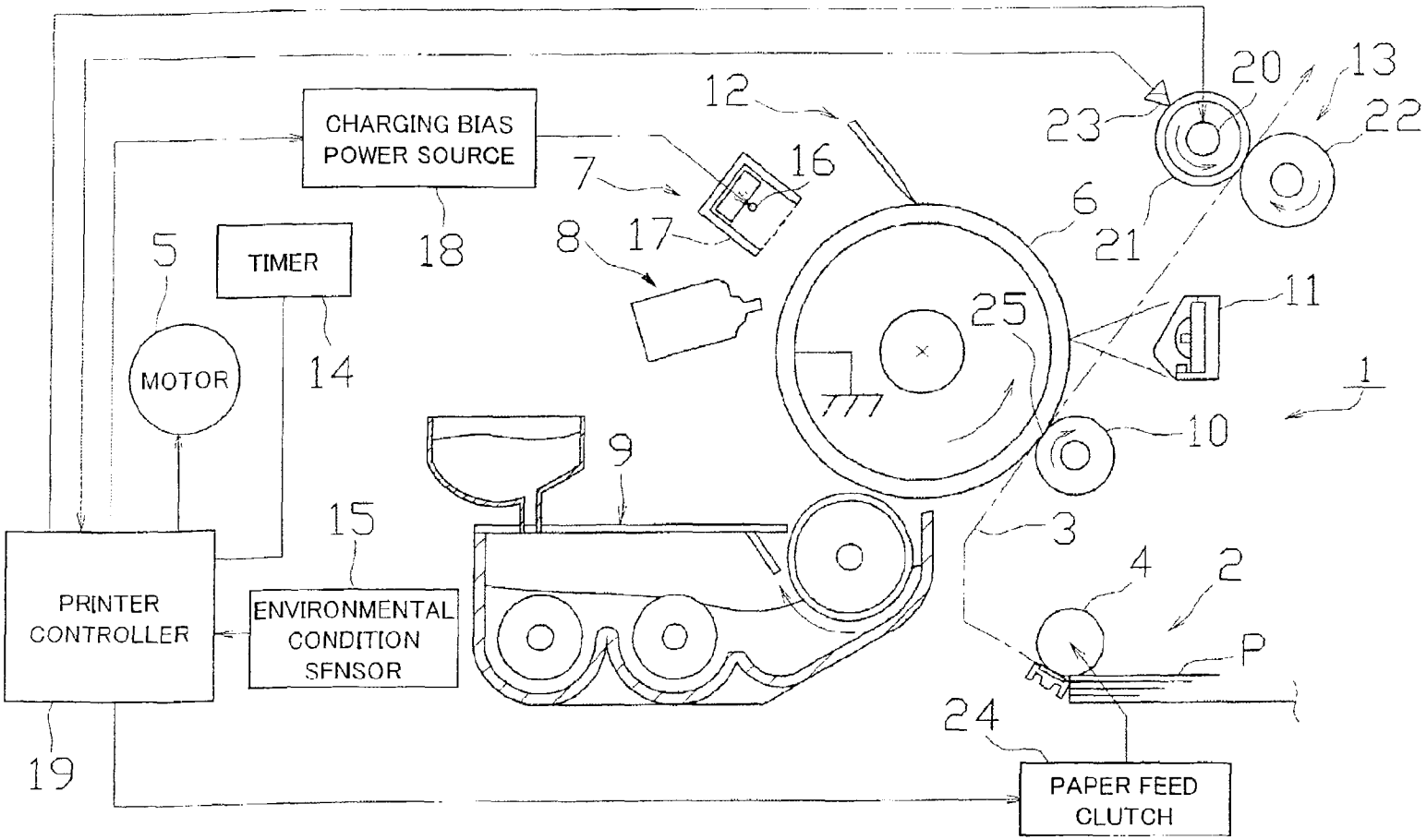
FIG. 1 is a schematic diagram illustrating a structure of an image forming device according to a preferred embodiment of the present invention.

FIG. 1 is a schematic diagram illustrating a structure of an image forming device 1 according to a preferred embodiment of the present invention. The image forming device 1 includes a paper feed cassette 2, a transportation path 3, a pickup roller 4, a motor 5, a photoconductive drum 6, a charging unit 7, an exposing unit 8, a developing unit 9, a transfer roller 10, a charge eliminating lamp 11, a cleaning blade 12, a fixing unit 13, a timer 14, and an environmental condition sensor 15. The paper feed cassette 2 accommodates printing papers P. The pickup roller 4 picks up the printing papers P accommodated in the paper feed cassette 2 and feeds the printing papers P into the transportation path 3. A photoconductive layer is formed on a surface of the photoconductive drum 6. The photoconductive drum 6 is driven and rotated by the motor 5. The charging unit 7 charges the surface of the photoconductive drum 6. The exposing unit 8 irradiates light on the surface of the photoconductive drum 6. The developing unit 9 supplies toner onto the surface of the photoconductive drum 6. The transfer roller 10 is contacted against the photoconductive drum 6. The printing paper P transported along the transportation path 3 is nipped between the transfer roller 10 and the photoconductive drum 6. The charge eliminating lamp 11 irradiates light on the surface of the photoconductive drum 6 to eliminate a charge from the surface of the photoconductive drum 6. The cleaning blade (abrasion tool) 12 removes foreign substances, such as the toner and paper dust, from the surface of the photoconductive drum 6. The fixing unit 13 heats and presses the printing paper P. The timer 14 measures time. The environmental condition sensor 15 detects an environmental condition near the photoconductive drum 6.

As illustrated in FIG. 1, the charging unit 7 preferably is a scorotron charging unit. A corona wire 16, including a tungsten wire or the like, is surrounded by a casing 17 to define the charging unit 7. The corona wire 16 is connected to a charging bias power source 18. A printer controller 19 controls an operation of the charging bias power source 18. A prescribed charging bias is applied from the charging bias power source 18 to the charging unit 7. Accordingly, a corona discharge is generated between the corona wire 16 and the photoconductive drum 6. As a result, air around the corona wire 16 is ionized and ions are generated. The generated ions are guided to the photoconductive drum 6, and the surface of the photoconductive drum 6 is charged.

As illustrated in FIG. 1, a tip end of the cleaning blade 12 is arranged to make contact with the photoconductive drum 6. While the photoconductive drum 6 is rotating, the cleaning blade 12 scrapes off the foreign substances, such as toner and paper dust, adhered on the surface of the photoconductive drum 6. In addition, the cleaning blade 12 abrades the surface of the photoconductive drum 6, which has been made uneven as a result of being polluted by corona product gases such as $NO_x$ and $O_3$ generated in the charging unit 7.

As illustrated in FIG. 1, the fixing unit 13 is arranged downstream of the photoconductive drum 6 along the transportation path 3. Since the fixing unit 13 heats and presses the printing paper P on which a toner image has been transferred, the toner image is fixed. The fixing unit 13 includes a heat roller 21, a press roller 22, and a temperature sensor 23. The heat roller 21 is an aluminum roller or the like including a heater 20. The press roller 22 is a rubber roller or the like which is pressed against the heat roller 21. The temperature sensor 23 detects a surface temperature of the heat roller 21. A detection result of the temperature sensor 23 is input to the printer controller 19. The printer controller 19 switches ON and OFF the heater 20, i.e., switches to start or stop a power supply to the heater 20, in accordance with the detection result of the temperature sensor 23. Accordingly, the temperature of the heat roller 21 can be controlled.

As illustrated in FIG. 1, the pickup roller 4 is driven and rotated by the motor 5, which drives the photoconductive drum 6. A paper feed clutch 24 intervenes between the motor 5 and the pickup roller 4. When the printer controller 19 controls to engage or disengage the paper feed clutch 24, a driving force of the motor 5 is transmitted or stopped with respect to the pickup roller 4. Although not illustrated in detail in the drawings, the environmental condition sensor 15 includes a temperature sensor for measuring an outside air temperature near the photoconductive drum 6, and a humidity sensor for measuring humidity near the photoconductive drum 6. The environmental condition sensor 15 appropriately allows matters which are susceptible to an environmental condition to be corrected, in order to improve accuracy of the control performed by the printer controller 19. The environmental condition sensor 15 and the timer 14 are controlled by the printer controller 19. Each detection result is input to the printer controller 19.

In the above-described image forming device 1, when a user issues a print job execution command, after a print job is started, first, a pre-rotation process is carried out. Under the pre-rotation process, the photoconductive drum 6 and the peripheral system of the photoconductive drum 6 are adjusted into an optimum state. The peripheral system of the photoconductive drum 6 includes, for example, the charging unit 7, the developing unit 9, and the transfer roller 10, or any other device that works in conjunction with the photoconductive drum 6. At the same time as a completion of the pre-rotation process, the printing papers P accommodated in the paper feed cassette 2 are fed into the transportation path 3, and an image forming process is carried out. A description will be made of the image forming process for one printing paper P. After the pre-rotation process has been completed, first, the surface of the photoconductive drum 6 is uniformly charged by the charging unit 7. The exposing unit 8 irradiates light according to the image data to be printed. Accordingly, an electric charge on the photoconductive drum 6 is partially removed, and an electrostatic latent image is formed. The developing unit 9 supplies the toner to the electrostatic latent image, and as a result, a toner image is formed. Meanwhile, in synchronism with the completion of the pre-rotation process, the printing papers P accommodated in the paper feed cassette 2 are picked up one sheet at a time from an uppermost sheet by the pickup roller 4. The picked-up printing paper P is fed into the transportation path 3. The printing paper P is pressed against the photoconductive drum 6 by the transfer roller 10 at a transfer nip position 25. Accordingly, the toner image formed on the photoconductive drum 6 is transferred onto the printing paper P. Furthermore, the printing paper P is transported downstream along the transportation path 3. When the printing paper P is heated and pressed by the fixing unit 13, the toner image on the printing paper P is fixed. Then, the printing paper P is output onto a paper output tray (not illustrated). Meanwhile, after the toner image has been transferred, the charge eliminating lamp 11 eliminates the electric charge from the surface of the photoconductive drum 6. The cleaning blade 12 removes the toner and the paper dust or the like remaining on the surface of the photoconductive drum 6. Then, the surface of the photoconductive drum 6 is charged again by the charging unit 7.

Figure 2:
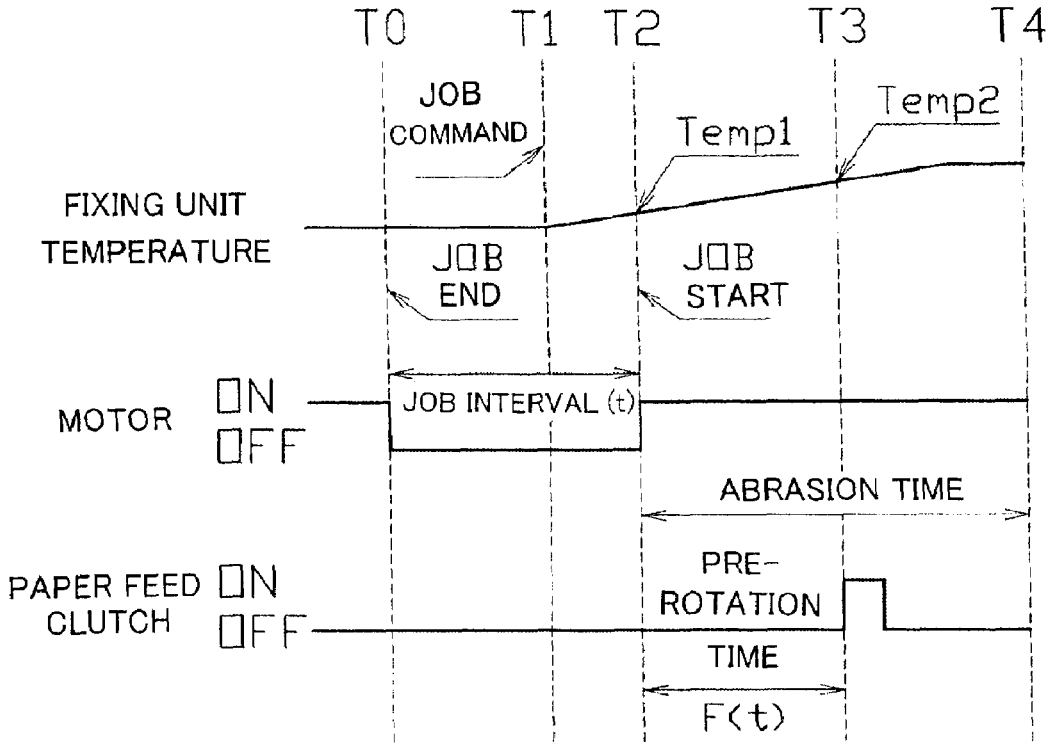
FIG. 2 is a time chart illustrating an operation control of a fixing unit, a motor, and a paper feed clutch from a completion of a previous print job until a start of a next print job.

Next, a detailed description will be made of the pre-rotation process. FIG. 2 is a time chart illustrating an operation control of the fixing unit 13, the motor 5, and the paper feed clutch 24 from a completion of a previous print job until a start of a next print job. As illustrated in FIG. 2, at time T0 when a previous print job ends, the printer controller 19 switches OFF a motor signal, which controls an operation of the motor 5. Accordingly, the motor 5, which has been rotating during the print job, stops. As a result, the photoconductive drum 6 and the transfer roller 10 or the like also stop rotating. The printer controller 19 starts the timer 14. The timer 14 starts to measure an elapse of time from the print job end time T0.

After a prescribed period of time elapses from the time T0, i.e., at time T1, when the user issues a print job execution command, the printer controller 19 switches on the heater 20 of the fixing unit 13. As a result, as illustrated in FIG. 2, a fixing unit temperature starts to increase at a prescribed temperature gradient. The temperature gradient is a value unique to the heat roller 21 determined by the material and shape of the heat roller 21. At time T2 when the fixing unit temperature reaches a prescribed rotation starting temperature Temp 1, the printer controller 19 stops the timer 14, and the measuring of the elapse of time from time T0 is ended. Accordingly, a job interval t, i.e., a period from an end of a previous print job until a start of a new print job, is measured. Then, the printer controller 19 calculates an execution period of the pre-rotation process (hereinafter referred to as a "pre-rotation period") F(t) in accordance with the job interval t. At time T2, a motor signal is switched ON, and a new print job is started. Then, the photoconductive drum 6 and the transfer roller 10 or the like start rotating, and the pre-rotation process is carried out until time T3, i.e., until the pre-rotation period F(t) elapses from the time T2. Further, the job interval t may be defined as a period of time from the time T0 when the previous print job ends until the time T1 when a new print job execution command is issued. The pre-rotation period F(t) may also be calculated based on such a definition.

Figure 3:
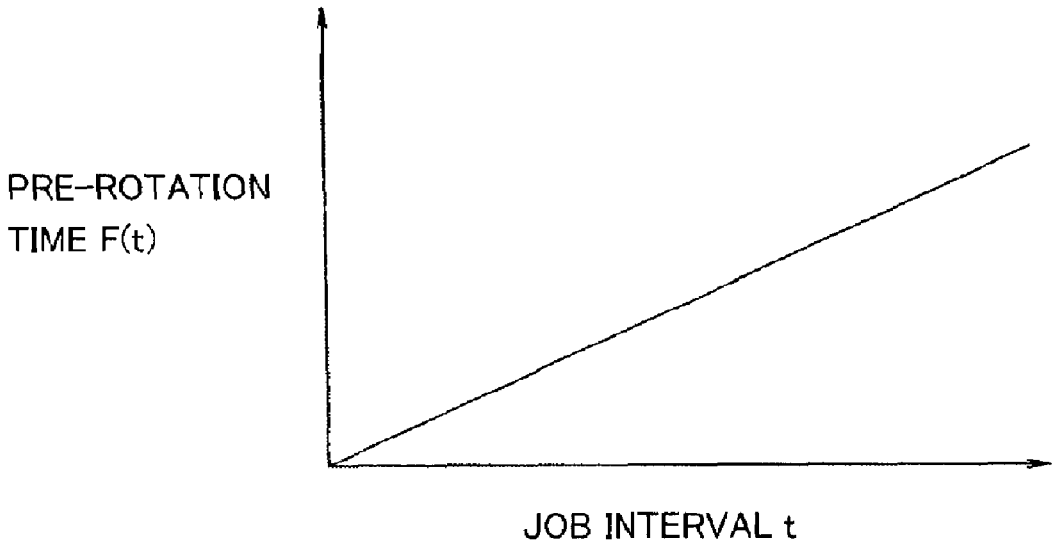
FIG. 3 is a graph illustrating an example of a relation between a job interval t and a pre-rotation period F(t).
Figure 4:
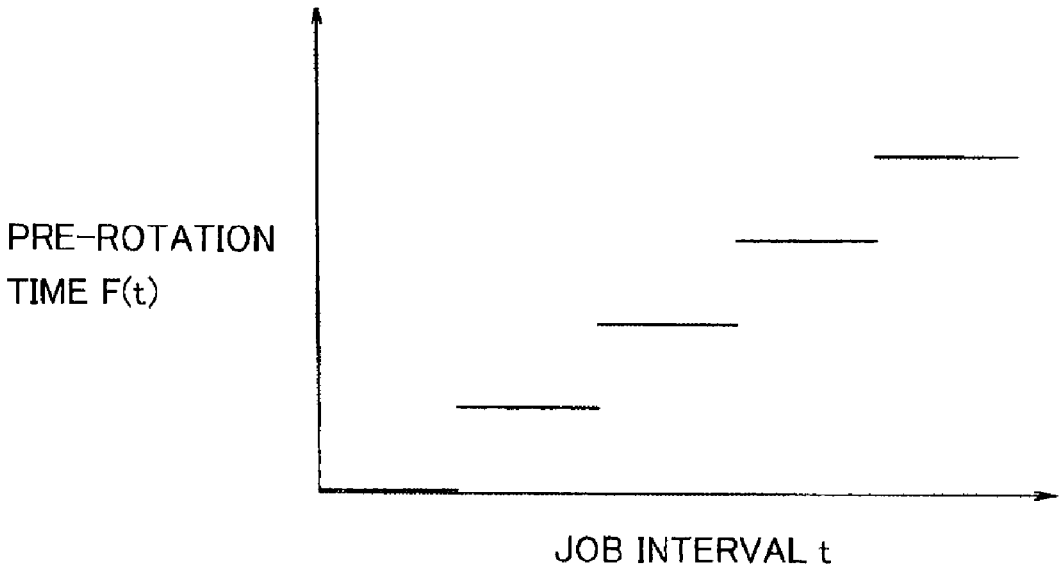
FIG. 4 is a graph illustrating an example of a relation between a job interval t and a pre-rotation period F(t).
Figure 5:
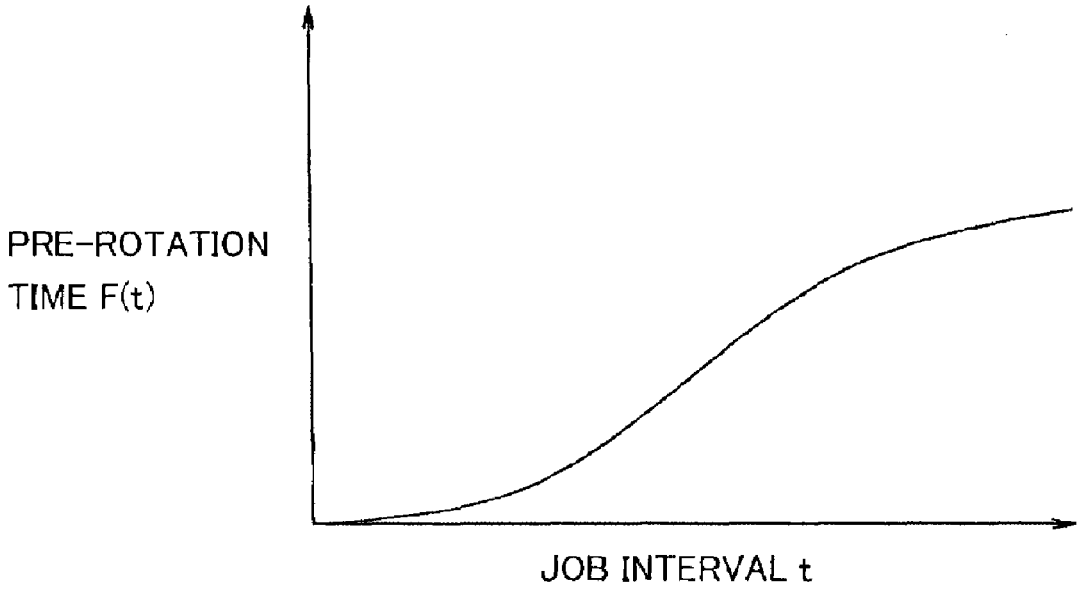
FIG. 5 is a graph illustrating an example of a relation between a job interval t and a pre-rotation period F(t).

Next, a description will be made of a method for calculating the pre-rotation period F(t), i.e., a method for calculating the time T3 when the pre-rotation process ends. First, the printer controller 19 calculates the theoretical value of the pre-rotation period F(t) by using a prescribed calculation formula in accordance with the job interval t. The printer controller 19 adds the theoretical value of the pre-rotation period F(t) to the time T2 to calculate the theoretical value of the ending time T3. That is, the pre-rotation period F(t) changes according to the job interval t. Therefore, according to the level of the pollution on the photoconductive drum 6 resulting from the discharge product gases, an abrasion period of the photoconductive drum 6 by the cleaning blade 12 becomes an optimum length. That is, when the image forming device 1 is left for a long period of time without any print job being carried out, for example, from an end of a week until a beginning of the next week, the level of the pollution on the photoconductive drum 6 resulting from the discharge product gases is high. Therefore, the pre-rotation period F(t) is lengthened, and the abrasion period by the cleaning blade 12 also becomes long. As a result, the surface of the photoconductive drum 6 is even more reliably refreshed. Meanwhile, when a next print job is started immediately after a completion of a previous print job, the level of the pollution on the photoconductive drum 6 by the discharge product gases is low. As a result, the pre-rotation period F(t) is shortened, and the abrasion period by the cleaning blade 12 also becomes short. Accordingly, the surface of the photoconductive drum 6 is reliably refreshed without a delay in the start of the next print job. Further, as a computation formula for calculating the pre-rotation period F(t) from the job interval t, for example, it is possible to use a linear function illustrated in FIG. 3, a step function illustrated in FIG. 4, or a logistic function illustrated in FIG. 5.

Next, in accordance with the temperature gradient, the printer controller 19 calculates a time when the fixing unit temperature, which was Temp 1 at time T2, reaches a predetermined paper feed starting temperature Temp 2. The printer controller 19 compares the time when the fixing unit temperature reaches the paper feed starting temperature Temp 2 with the theoretical value of the ending time T2 calculated as described above. Then, the printer controller 19 selects a time whichever is later. A condition of the fixing unit temperature is added to the theoretical value of the pre-rotation period F(t) as described above. This is because when the theoretical value of the pre-rotation period F(t) is small, the paper feeding is started before the fixing unit temperature increases sufficiently, and the fixing may be insufficient as a result of the fixing unit temperature not reaching the temperature necessary for fixing when the printing paper P passes through the fixing unit 13. In order to solve such a problem, a minimum required fixing unit temperature at time T2 is provided as a condition such that the fixing unit temperature has reached the temperature necessary for fixing when the printing paper P passes through the fixing unit 13.

Figure 6:
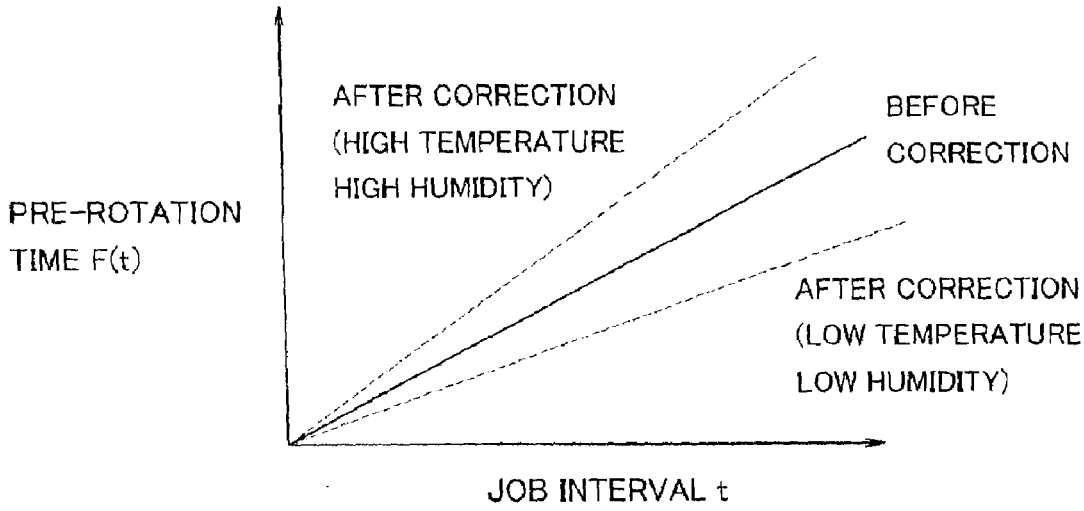
FIG. 6 illustrates an example of a correction of a pre-rotation period F(t) according to a detection result of an environmental condition sensor.

Lastly, the printer controller 19 detects the environmental condition from the environmental condition sensor 15. The printer controller 19 corrects the later time selected as described above in accordance with the detection result. The printer controller 19 calculates the corrected time as the ending time T3 of the pre-rotation process. As described above, since the correction is carried out in accordance with the detection result of the environmental condition sensor 15, an even more optimum ending time T3 can be calculated by considering a change in the level of the pollution on the photoconductive drum 6 resulting from a difference in the environmental condition. FIG. 6 illustrates an example of the correction of the pre-rotation period F(t) according to the detecting result of the environmental condition sensor 15. For example, under a condition of high temperature and high humidity, the discharge product gases generated in the charging unit 7 are prone to react with moisture in the air and the level of the pollution on the photoconductive drum 6 increases. Therefore, under such a condition, the pre-rotation period F(t) is corrected to be longer. Accompanying a lengthening of the abrasion time of the photoconductive drum 6, the photoconductive drum 6 can be refreshed even more reliably. Meanwhile, under a condition of low temperature and low humidity, it is difficult for the discharge product gases to react with the moisture in the air and the level of the pollution on the photoconductive drum 6 decreases. Therefore, under such a condition, the pre-rotation period F(t) is corrected to be shorter. Accompanying a shortening of the abrasion time of the photoconductive drum 6, it is possible to prevent a delay in the start of the next print job resulting from the pre-rotation period F(t) becoming unnecessarily long.

Further, in the present preferred embodiment, the pre-rotation period F(t) is calculated by adding the temperature condition of the fixing unit 13 to the theoretical value of the pre-rotation period F(t). Alternatively, the rotation starting temperature Temp 1 at time T2 may be calculated such that the fixing unit 13 reaches the temperature necessary for the fixing when the printing paper P passes through the fixing unit 13. Accordingly, without adding the condition of the fixing unit temperature, the theoretical value of the pre-rotation period F(t) can be directly provided as the pre-rotation period F(t).

As illustrated in FIG. 2, the printer controller 19 engages the paper feed clutch 24 in synchronism with the ending time T3 of the pre-rotation process. Then, the pickup roller 4 starts rotating. Accordingly, the uppermost sheet of the printing papers P in the paper feed cassette 2 is picked up by the pickup roller 4. The picked-up printing paper P is fed into the transportation path 3. When the paper feeding is completed, the printer controller 19 disengages the paper feed clutch 24. Then, the pickup roller 4 stops rotating. Subsequently, as illustrated in FIG. 2, the printing paper P fed at time T3 reaches the transfer nip position 25 at time T4. During a period of time from when the motor 5 starts rotating at time T2 until when the printing paper P reaches the transfer nip position 25 at time T4, the surface of the photoconductive drum 6 is abraded by the cleaning blade 12. When the pre-rotation period F(t) is shortened and the paper feed starting time T3 is made earlier than illustrated in FIG. 2, the time T4 at which the printing paper Preaches the transfer nip position 25 also becomes earlier to the same extent. As a result, the abrasion time of the photoconductive drum 6 from time T2 to time T4 is shortened. Meanwhile, when the pre-rotation period F(t) is lengthened and the paper feed starting time T3 is made later than illustrated in FIG. 2, the time T4 at which the printing paper P reaches the transfer nip position 25 is also delayed to the same extent. As a result, the abrasion time of the photoconductive drum 6 from time T2 to time T4 is lengthened.

Further, in the present preferred embodiment, the cleaning blade 12 is used as an abrasion tool for abrading and refreshing the polluted photoconductive drum 6. In place of the cleaning blade 12, in a system without a cleaning blade 12, in the case of the image forming device 1 using a one-component developing method, the photoconductive drum 6 may be abraded by scraping the photoconductive drum 6 with toner. In the case of the image forming device 1 using a two-component developing method, the photoconductive drum 6 may be abraded by scraping the photoconductive drum 6 by a carrier defining the two-component developer.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. An image forming device comprising:

a motor;

a photoconductive drum which is driven and rotated by the motor and includes a photoconductive layer provided on the photoconductive drum;

a charging unit which is arranged at a periphery of the photoconductive drum and charges the photoconductive drum by a corona discharge method;

an abrasion tool which is arranged at the periphery of the photoconductive drum and abrades a surface of the photoconductive drum while the photoconductive drum is rotating;

a timer which measures a job interval from a time when the motor is stopped to end a previous print job until when the motor is driven to start a next print job;

a controller which executes a pre-rotation process to adjust the photoconductive drum and a peripheral system of the photoconductive drum into an optimum state, and calculates a pre-rotation period when the pre-rotation process is to be executed according to the measured job interval;

a paper feed cassette which accommodates at least one printing paper;

a pickup roller which picks up the printing paper accommodated in the paper feed cassette one sheet at a time; and a fixing unit which heats and fixes a toner image transferred onto the printing paper from the photoconductive drum; wherein the abrasion tool is a cleaning blade having a tip end arranged in contact with the photoconductive drum;

the controller starts to rotate the pickup roller in synchronism with an end of the pre-rotation process, and feeds a first sheet of the printing paper from the paper feed cassette; and the controller selects one of an execution period calculated in accordance with the job interval and an execution period required from a start of the next print job until when the fixing unit reaches a predetermined paper feed starting temperature, whichever is longer, as the pre-rotation period for the next print job.

2. An image forming device comprising:

a motor;

a photoconductive drum which is driven and rotated by the motor and includes a photoconductive layer provided on the photoconductive drum;

a charging unit which is arranged at a periphery of the photoconductive drum and charges the photoconductive drum by a corona discharge method;

an abrasion tool which is arranged at the periphery of the photoconductive drum and abrades a surface of the photoconductive drum while the photoconductive drum is rotating;

a timer which measures a job interval from a time when the motor is stopped to end a previous print job until when the motor is driven to start a next print job; and a controller which executes a pre-rotation process to adjust the photoconductive drum and a peripheral system of the photoconductive drum into an optimum state, and calculates a pre-rotation period when the pre-rotation process is to be executed according to the measured job interval; wherein the abrasion tool is a cleaning blade having a tip end arranged in contact with the photoconductive drum; and the controller calculates the pre-rotation period from the job interval by using a step function as a computation formula.

3. An image forming device comprising:

a motor;

a photoconductive drum which is driven and rotated by the motor and includes a photoconductive layer provided on the photoconductive drum;

a charging unit which is arranged at a periphery of the photoconductive drum and charges the photoconductive drum by a corona discharge method;

an abrasion tool which is arranged at the periphery of the photoconductive drum and abrades a surface of the photoconductive drum while the photoconductive drum is rotating;

a timer which measures a job interval from a time when the motor is stopped to end a previous print job until when the motor is driven to start a next print job; and a controller which executes a pre-rotation process to adjust the photoconductive drum and a peripheral system of the photoconductive drum into an optimum state, and calculates a pre-rotation period when the pre-rotation process is to be executed according to the measured job interval; wherein the abrasion tool is a cleaning blade having a tip end arranged in contact with the photoconductive drum; and the controller calculates the pre-rotation period from the job interval by using a logistic function as a computation formula.

4. An electrophotographic image forming method for charging a surface of a photoconductive drum by a corona discharge, the image forming method comprising the steps of:

measuring a job interval from a time when a motor is stopped to end a previous print job until when the motor is driven to start a next print job;

calculating a pre-rotation period when a pre-rotation process is executed according to the measured job interval;

executing the pre-rotation process over the pre-rotation period for adjusting the photoconductive drum and a peripheral system of the photoconductive drum into an optimum state; and selecting one of an execution period calculated in accordance with the job interval and an execution period required from a start of the next print job until a fixing unit reaches a predetermined paper feed starting temperature, whichever is longer, as the pre-rotation period of the pre-rotation process for the next print job.

5. The electrophotographic image forming method according to claim 4, further comprising the step of:

setting the pre-rotation period long when the job interval is long and setting the pre-rotation period short when the job interval is short.

6. The electrophotographic image forming method according to claim 5, further comprising the steps of:

detecting an environmental condition near the photoconductive drum; and correcting the pre-rotation period for the next print job according to the detected environmental condition.

7. The electrophotographic image forming method according to claim 6, further comprising the step of:

correcting the pre-rotation period to be long when a detected environmental condition is high temperature and high humidity, and correcting the pre-rotation period to be short when the detected environmental condition is low temperature and low humidity.

8. The electrophotographic image forming method according to claim 5, further comprising the step of:

feeding printing paper and carrying out an image forming process at a same time as a completion of the pre-rotation process.

9. The electrophotographic image forming method according to claim 5, further comprising the step of:

calculating the pre-rotation period from the job interval by using a linear function as a computation formula.

10. The electrophotographic image forming method according to claim 5, further comprising the step of:

calculating the pre-rotation period from the job interval by using a gauss function as a computation formula.

11. The electrophotographic image forming method according to claim 5, further comprising the step of:

calculating the pre-rotation period from the job interval by using a logistic function as a computation formula.

* * * * *